US009914032B2

(12) United States Patent
Simpson

(10) Patent No.: US 9,914,032 B2
(45) Date of Patent: Mar. 13, 2018

(54) MULTI FUNCTIONAL GOLF TOOL

(71) Applicant: W. Frank Simpson, Rock Hill, SC (US)

(72) Inventor: W. Frank Simpson, Rock Hill, SC (US)

( * ) Notice: Subject to any disclaimer, the term of this patent is extended or adjusted under 35 U.S.C. 154(b) by 0 days.

(21) Appl. No.: 14/940,168

(22) Filed: Nov. 13, 2015

(65) Prior Publication Data

US 2017/0136324 A1 May 18, 2017

(51) Int. Cl.

| | |
|---|---|
| ***A63B 57/00*** | (2015.01) |
| ***A63B 57/50*** | (2015.01) |
| ***A63B 55/10*** | (2006.01) |
| ***A47G 25/82*** | (2006.01) |
| ***A63B 47/00*** | (2006.01) |
| ***A63B 57/60*** | (2015.01) |
| *A63B 47/04* | (2006.01) |
| *A63B 71/06* | (2006.01) |

(52) U.S. Cl.

CPC ..... *A63B 57/50* (2015.10); *A47G 25/82* (2013.01); *A63B 47/00* (2013.01); *A63B 55/10* (2013.01); *A63B 57/60* (2015.10); *A63B 47/04* (2013.01); *A63B 2071/0694* (2013.01); *A63B 2225/30* (2013.01)

(58) Field of Classification Search

CPC ..... A63B 57/00; A63B 57/50; A47G 25/82
USPC ..... 473/285, 286, 406, 408
See application file for complete search history.

(56) References Cited

U.S. PATENT DOCUMENTS

| | | | | |
|---|---|---|---|---|
| 2,222,145 | A | 11/1940 | James | |
| 2,904,373 | A * | 9/1959 | Dowdy | B25G 1/00 30/342 |
| 3,047,896 | A | 8/1962 | Gunderson | |
| 3,089,172 | A | 5/1963 | Walden | |
| 3,618,673 | A | 11/1971 | Gossett | |
| 4,007,928 | A * | 2/1977 | Doubt | A47G 25/82 223/118 |
| 4,063,731 | A | 12/1977 | Kitay | |
| D300,160 | S * | 3/1989 | Johnson | D2/642 |
| D308,713 | S * | 6/1990 | Sherry | D21/793 |
| 5,022,650 | A | 6/1991 | Madock | |
| 5,226,647 | A * | 7/1993 | Notarmuzi | A24F 13/22 15/236.08 |
| 5,645,500 | A * | 7/1997 | Borden | A63B 57/00 473/286 |
| D385,323 | S * | 10/1997 | Horton | D21/793 |
| D395,480 | S * | 6/1998 | Chou | D21/759 |
| 5,788,197 | A | 8/1998 | Tutela | |
| D422,664 | S * | 4/2000 | Tate | D21/793 |
| 6,270,424 | B1 * | 8/2001 | Holub | A63B 47/04 15/105 |
| 6,413,173 | B1 | 7/2002 | Muller et al. | |

(Continued)

*Primary Examiner* — Nini Legesse
(74) *Attorney, Agent, or Firm* — Memminger E. Wiggins

(57) ABSTRACT

The invention relates to a multi functional golf tool that can be used to address a variety of circumstances that commonly arise during a game of golf. The multi functional tool includes a rectangular body having a proximal end, a tapered distal end being opposite said proximal end, the rectangular body having an arcuate cross-section along its entire length. The invention includes a deburring surface for repairing golf ball scratches, a pair of tines for divot repair and to clean golf club face grooves, and areas for marketing indicia. The shape and configuration of the invention also permits it to be used as a shoe horn.

14 Claims, 2 Drawing Sheets

(56) References Cited

U.S. PATENT DOCUMENTS

| | | | | |
|---|---|---|---|---|
| 6,571,414 | B1 * | 6/2003 | Krenzler | A63B 47/04<br>451/559 |
| 6,939,254 | B2 | 9/2005 | Tiefel | |
| 6,997,824 | B2 | 2/2006 | Cranman | |
| 8,020,473 | B2 * | 9/2011 | Tsai | B23D 71/04<br>451/461 |
| 8,342,986 | B2 | 1/2013 | Rourke | |
| 2011/0015001 | A1 | 1/2011 | Hafdal | |

* cited by examiner

MULTI FUNCTIONAL GOLF TOOL

FIELD OF THE INVENTION

The present invention generally relates to multi functional golf tools. More specifically, the present invention relates to a multi functional golf ball deburring tool for the removal of scratches from the surface of a golf ball, as well as additional tools often used by golfers during a round of golf.

BACKGROUND OF THE INVENTION

Golf is a game of many challenges and as a consequence there are numerous golf tools available to golfers to help them meet such challenges. The skill of a golfer is challenged throughout a round of golf. Golf equipment manufacturers are constantly challenged to incorporate the latest technological advances into its equipment for the golfers to utilize. Additionally, the golf course managers are challenged on a daily basis to properly maintain the condition of the large outdoor areas required for golf courses.

Due to technological advances, as well as the ingenuity and inventive nature of golfers, new products are constantly being designed to help the golfer address those individual challenges which he may incur during a round of golf. There are a variety of individual devices, as well as devices that are a combination of devices, available in the market place to assist golfers of varying degrees of skill. There are golf tools, both manual and electronic, available to measure distance on the golf course. There are golf tools available to help a golfer return his golf ball to its exact location once the golf ball is moved. There are golf tools available for the golfers to help the golf course management maintain and repair the golf course fairways and greens. There are tools available to help the golfer to keep his golf equipment and supplies clean and free from debris. There are tools available to help a golfer to find his lost ball. The list of such golf ball tools is long. As a result of all the challenges encountered by a golfer, there is an ongoing effort by both manufacturers and golfers to create new tools address such challenges and needs of golfers.

In light of the constant advances in technology and the changes in a golfer's level of skill, there remains a need for golf tools to assist the golfer with the various challenges that are always present for this unique game.

Accordingly, there remains room for improvement and variation within the art.

SUMMARY OF THE INVENTION

It is at least one aspect of the present embodiments to provide a multi functional golf tool comprising a rectangular body; a deburring surface for the repair of a scratched golf ball or a scratched golf club face, a pair of tines extending from the rectangular body for the repair of divots and ball marks on a golf course; first and second marketing surfaces for advertising indicia; an aperture for use as an attaching means for carrying the present invention; and first and second golf club support surfaces to prevent golf club grips from coming into contact with the ground.

It is at least one aspect of the present embodiments to provide a rectangular body having a proximal end, a tapered distal end that is opposite the proximal end of the rectangular body, a convex bottom surface, a concave top surface that is parallel to the convex bottom surface so that the convex bottom surface and the concave top surface form a body edge about the rectangular body.

It is at least one aspect of the present embodiments to provide that the shape and configuration of the convex bottom surface and the concave top surface result in the rectangular body having an arcuate cross-section along its entire length.

It is still a further aspect of at least one of the present embodiments to provide a deburring surface on the convex bottom surface of the rectangular body.

It is a further aspect of at least one of the present embodiments to provide a pair of pointed tines disposed on and extending therefrom the tapered distal end of the rectangular body.

It is at least one aspect of the present embodiments to provide a first marketing surface adjacent to the deburring surface on the convex bottom surface of the rectangular body and a second marketing surface on the concave top surface of the rectangular body, wherein said surfaces can be used for the display of advertising indicia.

It is at least one aspect of the present embodiments to provide an aperture at the proximal end of the rectangular body, the aperture being structured and configured to serve as a means for attaching the present invention to its user, a golf bag, a golf cart, or the like for transporting, with a key chain or such tether-like device or for attachment to advertising or sales racks in stores.

It is a further aspect of at least one of the present embodiments to provide a first golf club support surface located at the proximal end of the rectangular body and a second golf club support surface located at the concave top surface of the rectangular body, wherein said golf club support surfaces maintain a golf club grip off the ground.

It is at least one aspect of the present embodiments to provide a multi functional golf tool that can be used as a shoe horn.

It is a further aspect of at least one of the present embodiments to provide a multi functional golf tool that fits comfortably within a golfer's hand and fingers, and therefore be more securely grasped during use as a deburring tool, a divot tool, a golf club support surface, a shoe horn, or as a device for cleaning the grooves on a golf club face.

It is a further aspect of at least one of the present embodiments to provide a multi functional golf tool having a size that can be easily carried in a golfer's pocket or golf bag when not being used.

It is at least one aspect of the present embodiments to provide a multi functional golf tool manufactured from metal or thermoplastic materials having sufficient rigidity for the device's intended uses. Such thermoplastic materials include polystyrene, polyethylene, polypropylene, polyphthalamides, and the like.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
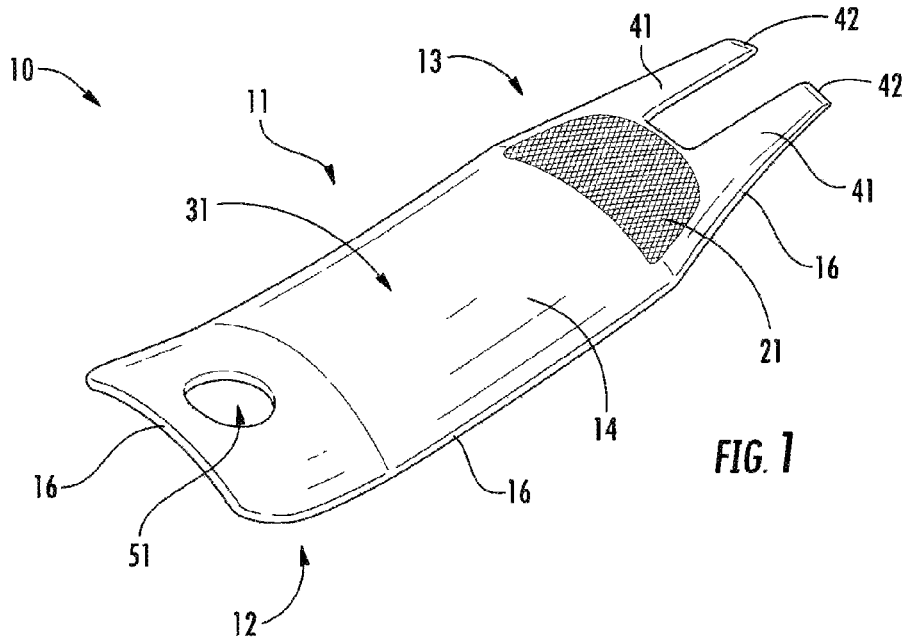
FIG. 1 is a perspective view of the convex bottom surface of a multi functional golf tool.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

As seen in reference to FIGS. 1, 2, 3, 4, 5, and 6, a multi functional golf tool 10 is provided. In accordance to the present invention, a multi functional golf tool 10 comprising a rectangular body 11, a deburring surface 21, a pair of tines 41 extending from the rectangular body 11, first and second marketing surfaces 31, 32, an aperture 51 for use as an attaching means, and first and second golf club support surfaces 61, 62.

Now referring to FIGS. 1, 2, 5, and 6, the rectangular body 11 of the present invention includes a proximal end 12, a tapered distal end 13 that is opposite the proximal end 12 of the rectangular body 11, a convex bottom surface 14, a concave top surface 15 that is parallel to the convex bottom surface 14 so that the convex bottom surface and the concave top surface form a body edge 16 about the rectangular body 11. The shape and configuration of the convex bottom surface 14 and the concave top surface 15 result in the rectangular body 11 having an arcuate cross-section along its entire length.

Figure 3:
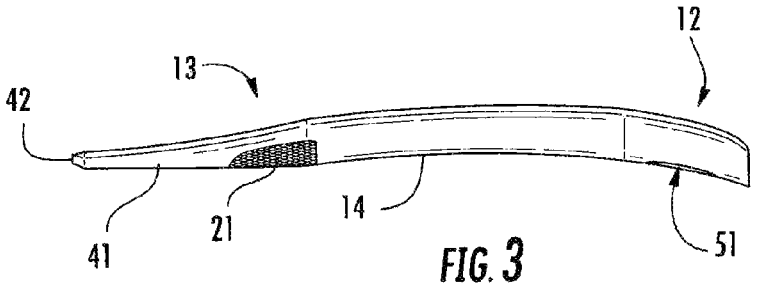
FIG. 3 is a side view of a multi functional golf tool.
Figure 4:
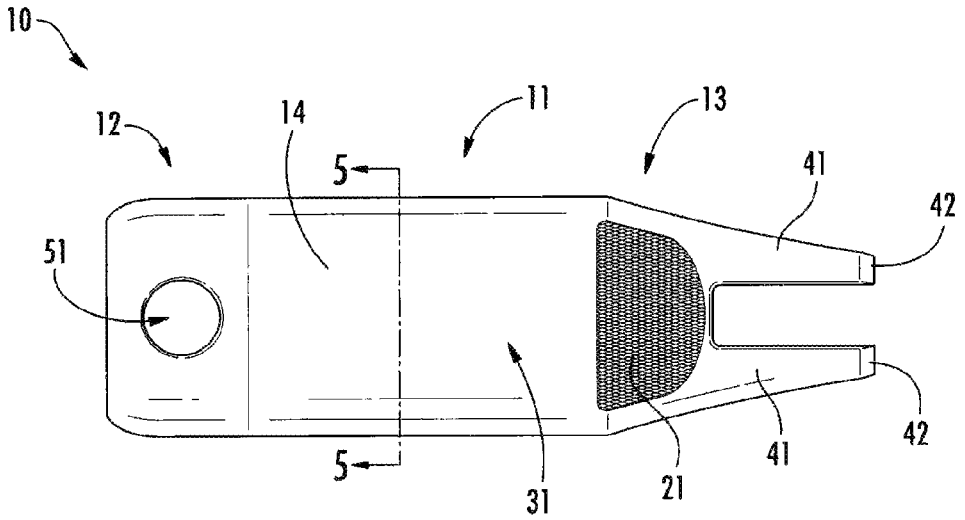
FIG. 4 is a bottom view of a multi functional golf tool.

The surface of a golf ball can become scratched as a result of its impact with hard, rough surfaces such as trees, golf cart paths, rocks, and such other abrasive surfaces often encountered on a golf course. Referring to FIGS. 1, 3, and 4, the present invention is manufactured to include a deburring surface 21 on a portion of its convex bottom surface 14 so that it can be used as a deburring tool. The deburring surface 21 can be used to repair the surface of a golf ball that has become scratched. Likewise, the deburring surface 21 of the present invention can be used to repair minor scratches on the face of a golf club. The convex shape of bottom surface 14 of the present invention facilitates engaging the deburring surface 21 with the rounded surface of a scratched golf ball or the surface of a golf club face. Although a preferred embodiment of the present invention includes a double cut file surface pattern for the deburring surface, alternate file patterns may be used if such a pattern provides adequate deburring capabilities with regard to the material from which the present invention is manufactured.

As illustrated in FIGS. 1, 2, 4, and 6, the rectangular body 11 of the present invention includes a pair of tines 41 disposed on the tapered distal end 13 of the rectangular body 11 for the repair of divots and ball marks on the golf course. The pair of tines 41 extend outward from the tapered distal end 13 of the rectangular body 11 in a parallel fashion with each tine coming to a pointed end 42. In a preferred embodiment of the present invention the pair of tines 41 are used for the repair of divots or golf ball impact marks on golf course greens or fairways. Additionally, the pointed ends 42 of the pair of tines 41 can be used to clean and remove debris from the grooves a golf club face.

Continuing to refer to FIGS. 1, 2, 4, and 6, the present invention includes a first marketing surface 31 located adjacent to the deburring surface 21 on the convex bottom surface 14 of the rectangular body 11. The present invention also includes a second marketing surface 32 located on the concave top surface 15 of the rectangular body 11. The first and second marketing surfaces 31, 32 can be used for the display of advertising indicia of various types.

In a preferred embodiment of the present invention an aperture 51, as shown in FIGS. 1, 2, 4, 5, and 6 is located at, the proximal end 12 of the rectangular body 11. The aperture 51 is structured and configured to serve as a means for attaching the present invention to its user, a golf bag, a golf cart, or the like for transporting, with a key chain or such tether-like device. In an alternative embodiment the aperture 51 of the present invention can be utilized for attachment to advertising or sales racks in golf course pro shops, sporting goods stores, or such other commercial retail venues for the sale and distribution of the present invention to the public.

Figure 2:
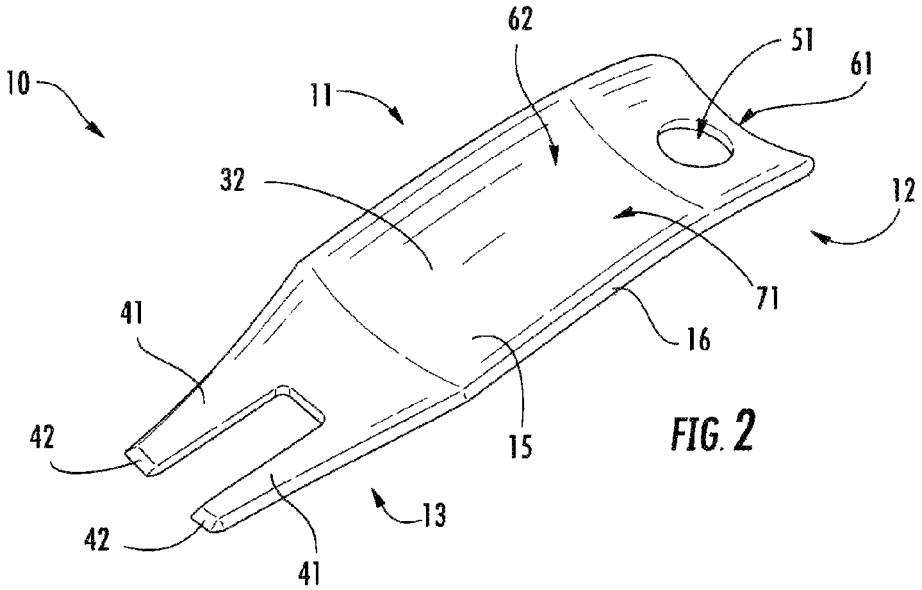
FIG. 2 is a perspective view of the concave top surface of a multi functional golf tool.
Figure 5:
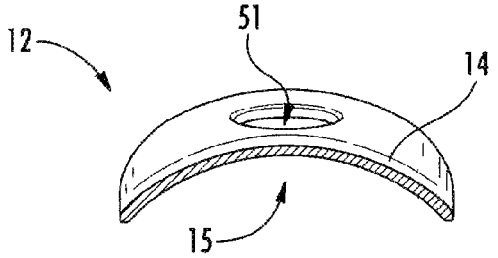
FIG. 5 is a cross-sectional view of a multi functional golf tool.
Figure 6:
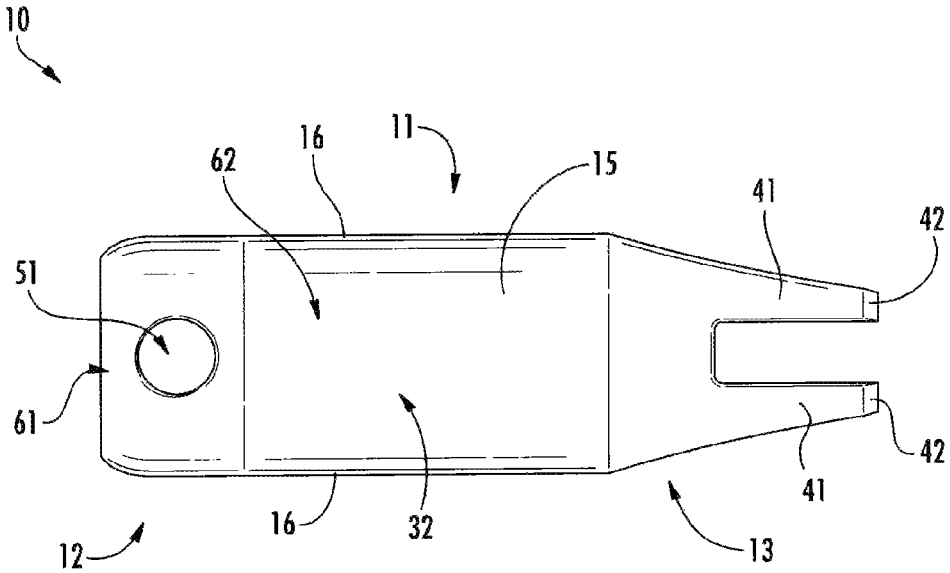
FIG. 6 is a top plan view a multi functional golf tool.

In another embodiment of the present invention a first golf dub support surface 61 is located at the proximal end 12 of the rectangular body 11 as shown in FIGS. 2 and 6. The first golf club support surface 61 is shaped and configured so that when the pair of tines 41 on the distal end 13 of the rectangular body 11 is pushed into the ground, a golf club grip can be placed onto the first golf club support surface 61 so that the golf club grip does not come into contact with the ground. Depending on the nature and consistency of the ground, the pair of tines 41 may be pushed vertically into the ground, or alternatively pushed into the ground at an angle, for the support of the golf club grip. The arcuate cross-section illustrated in FIG. 5 is present along the entire length of the rectangular body 11 of the present invention provides a concave shape to the first golf club support surface 61 to maintain the golf club in position.

Continuing to refer to FIGS. 2 and 6, a second golf club support surface 62 is located on the concave top surface 15 of the rectangular body 11. The concave top surface 15 of the rectangular body 11 is shaped and configured in an arcuate fashion so that when the multi functional golf tool 10 is placed horizontally on the ground with the convex bottom surface 14 in communication with the ground a golf club grip can placed onto the rectangular body 11 and be securely maintained off the ground. As shown specifically in FIG. 3, the present invention being shaped and configured in a slightly arched manner from its proximal end 12 to its distal tapered end 13 to elevate and maintain a golf club grip off the ground.

Another embodiment of the present invention includes its use as a shoe horn. The combination of the arcuate cross-section, shown in FIG. 5, along the entire length of the rectangular body 11 together with the curvature of the proximal end 12 of the rectangular body 11, as shown in FIGS. 1 and 2, produces the shape and curvature of a typical shoe horn. When used as a shoe horn the proximal end 12 and a sufficient length of the rectangular body 11 of the present invention is inserted inside the heal section of a golf shoe to guide a person's foot into a golf shoe.

Now referring to FIGS. 1, 2, and 5, the overall arcuate shape of the present invention due to the convex bottom surface 14 of the rectangular body 11 being parallel to the concave top surface 15 of the rectangular body 11 provides the present invention with a shape that fits comfortably within a golfer's hand, and therefore be more securely grasped during use as a deburring tool, a divot tool, a golf club support surface, a shoe horn, or as a device for cleaning the grooves on a golf club face.

The present invention can be manufactured in a range of sizes that can be easily carried in a golfer's pocket or golf bag when not being used. Referring to FIGS. 1, 2, 4, and 6, dimensions of a preferred embodiment of the present invention include a rectangular body 11 having a length of about 3 inches and a width of about 1⅛ inches and a pair of tines 41 extending from the tapered distal end 13 of the rectangular body 11 having a length of about 13/16 inch.

The present invention can be economically manufactured by an injection molding process using thermoplastic materials such as polystyrene, polyethylene, polypropylene, polyphthalamides, and the like to produce a multi functional golf tool having minimum weight and sufficient rigidity for divot repair, shoe horn leverage, and deburring a scratched golf ball surface but not too brittle resulting unwanted breakage. The present invention may also manufactured from metal materials having sufficient rigidity for the device's intended uses.

Although preferred embodiments of the invention have been described using specific terms, devices, and methods, such description if for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained herein.

That which is claimed:

1. A multi functional golf tool comprising:

a rectangular body having a proximal end, a tapered distal end being opposite said proximal end, a convex bottom surface, a concave top surface parallel to the convex bottom surface forming a body edge, the rectangular body having an arcuate cross-section along its entire length, a deburring surface for the repair of a golf ball having a scratch due to impact with an abrasive surface, the deburring surface being formed into an area of the convex bottom surface of the rectangular body adjacent to the tapered distal end of the rectangular body and comprising a double cut surface pattern designed and configured to engage the scratch on the golf ball for smoothing said scratch, wherein the concave top surface of the rectangular body being designed and configured to conform to and to receive a user's finger and to provide maximum grip by said user in order to exert pressure to a golf ball surface when repairing said golf ball, a pair of tines disposed on the tapered distal end of the rectangular body for the repair of divots and ball marks on a golf course and for the cleaning and removal of debris from the grooves of a golf club face, said pair of tines extending outward in a parallel fashion from the tapered distal end of the rectangular body and terminating at respective pointed ends, a first marketing surface on the convex bottom surface of the rectangular body for the display of advertising indicia, said first marketing surface being centrally located between the proximal end of said rectangular body and said deburring surface located adjacent to the distal end of the rectangular body, a second marketing surface on the concave top surface of the rectangular body for the display of advertising indicia, said second marketing surface being centrally located between the proximal end of the rectangular body and the distal end of the rectangular body, a first golf club support surface at the proximal end of the rectangular body, the first golf club support surface having a concave shape so that when the pair of tines is pushed vertically into the ground a convex golf club grip can be placed onto the first golf club support surface to be securely maintained off the ground, and a second golf club support surface at the concave top surface of the rectangular body, the concave top surface of the rectangular body being shaped and configured to have sufficient longitudinal arc so that when the multi functional golf tool is placed horizontally on the ground with the convex bottom surface in communication with the ground a convex golf club grip can placed onto the rectangular body to be maintained off the ground.

2. The multi functional golf tool of claim 1, wherein the deburring surface is used to repair scratches located on a golf club face.

3. The multi functional golf tool of claim 1, wherein the proximal end of the rectangular body is shaped and configured for use as a shoe horn.

4. The multi functional golf tool of claim 1, wherein the rectangular body having a length of approximately 3 inches and a width of approximately 1⅛ inches, and the pair of tines extending outward from the tapered distal end of the rectangular body having, a length of approximately 13/16 inches.

5. The multi-function golf tool of claim 1, wherein said multi functional golf tool is constructed of a material having sufficient rigidity for use as a deburring tool having a double cut surface pattern for the repair of a scratched golf ball, a divot tool for the repair of divots and ball marks on a golf course and for the cleaning and removal of debris from the grooves of a golf club face, first and second marketing, surfaces for advertising indicia; and first and second golf club support surfaces to prevent golf club grips from coming into contact with the ground.

6. The multi functional golf tool of claim 5, where said material includes lightweight metals and thermoplastic materials, the thermoplastic materials comprising polystyrene, polyethylene, polypropylene, and polyphthalamides.

7. A multi functional golf tool comprising:

a rectangular body having a proximal end-and a tapered distal end being opposite said proximal end, the rectangular body having an arcuate cross-section along its entire length, a convex bottom surface comprising a deburring surface adjacent to the tapered distal end of the rectangular body for the repair of a golf ball having a scratch due to impact with an abrasive surface, the deburring surface comprising a double cut surface pattern designed and configured to engage the scratch on the golf ball for smoothing said scratch and a first marketing surface centrally located between the proximal end of said rectangular body and said deburring surface for the display of advertising indicia, a concave top surface having a second marketing surface centrally located between the proximal end of the rectangular body and the distal end of the rectangular body for the display of advertising indicia, wherein the concave top surface of the rectangular body being designed and configured to conform to and to receive a user's finger and to provide maximum grip by said user in order to exert pressure to a golf ball surface when repairing said golf ball, and a pair of tines disposed on the tapered distal end of the rectangular body and extending outward in a parallel fashion from the tapered distal end of the rectangular body and terminating at respective pointed ends, said pair of tines being designed and configured for the repair of divots and ball marks on a golf course and for the cleaning and removal of debris from the grooves of a golf club face.

8. The multi functional golf tool of claim 7, wherein the proximal end of the rectangular body further comprising a first golf club support surface having a concave shape so that when the pair of tines is pushed vertically into the ground a convex golf club grip can be placed onto the first golf club support surface to be securely maintained off the ground.

9. The multi functional golf tool of claim 7, wherein the concave top surface of the rectangular body further comprising a second golf club support surface shaped and configured to have sufficient longitudinal arc so that when the multi functional golf tool is placed horizontally on the ground with the convex bottom surface in communication with the ground a convex golf club grip can placed onto the rectangular body to be maintained off the ground.

10. The multi functional golf tool of claim 7, wherein the proximal end of the rectangular body is shaped and configured for use as a shoe horn.

11. The multi-function golf tool of claim 7, wherein said multi functional golf tool is constructed of a material having sufficient rigidity for use as a deburring tool having a double cut surface pattern for the repair of a scratched golf ball, a divot tool having a pair of tines extending outward in a parallel fashion from the tapered distal end of the rectangular body for the repair of divots and ball marks on a golf course and for the cleaning and removal of debris from the grooves of a golf club face, first and second marketing surfaces for advertising indicia; and first and second golf club support surfaces to prevent golf club grips from coming into contact with the ground.

12. The multi functional golf tool of claim 11, where said material includes lightweight metals and thermoplastic materials, the thermoplastic materials comprising polystyrene, polyethylene, polypropylene, and polyphthalamides.

13. The multi functional golf tool of claim 7, wherein the rectangular body having a length of approximately 3 inches and a width of approximately 1⅛ inches, and the pair of tines extending outward from the tapered distal end of the rectangular body having a length of approximately 13/16 inches.

14. The multi functional golf tool of claim 7, wherein the deburring surface is used to repair scratches located on a golf club face.

* * * * *